United States Patent [19]

Newton

[11] 4,407,499

[45] Oct. 4, 1983

[54] BOWLING AID

[75] Inventor: Jimmy D. Newton, Midland, Tex.

[73] Assignee: Thomas L. Taylor, Odessa, Tex.

[21] Appl. No.: 269,669

[22] Filed: Jun. 2, 1981

[51] Int. Cl.[3] ..... A63B 71/02

[52] U.S. Cl. ..... 273/54 B

[58] Field of Search ..... 273/54 B, 189 A; 128/87 R, 89; 2/161 A

[56] References Cited

U.S. PATENT DOCUMENTS

| | | | |
|---|---|---|---|
| 3,421,761 | 1/1969 | Grant | 273/54 B |
| 3,467,379 | 9/1969 | Kistner | 273/54 B |
| 3,788,307 | 1/1974 | Kistner | 128/87 R X |
| 3,790,168 | 2/1974 | Hashimoto | 273/54 B |
| 4,228,548 | 10/1980 | Cohen | 273/54 B X |

*Primary Examiner*—Anton O. Oechsle
*Attorney, Agent, or Firm*—Marcus L. Bates

[57] ABSTRACT

A bowling aid is constructed to include a panel member from which there extends a finger guide and stiffener member. Cutouts enable the panel member to be wrapped about the hand and wrist in a manner to expose the thumb and fingers. Overlapping parts of the panel are attached to one another by Velcro fasteners. The stiffener and guide member includes a tongue part which is received within a pocket formed within the panel. The finger guide is positioned forwardly of the stiffener member and extends forwardly of the panel member for receiving the knuckles of one's second and third fingers therewithin. The fingers, hand, wrist, and forearm are restrained by the bowling aid device in a manner which increases one's bowling skill.

4 Claims, 5 Drawing Figures

FIG. 1
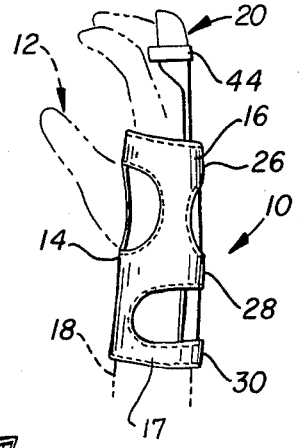
FIG. 2
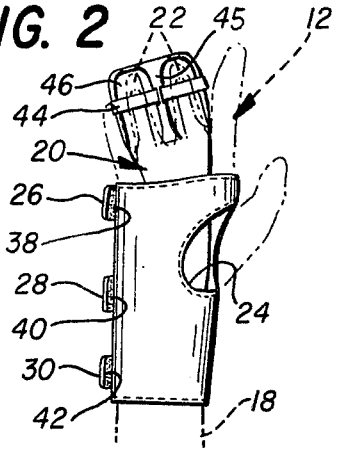
FIG. 3
FIG. 4
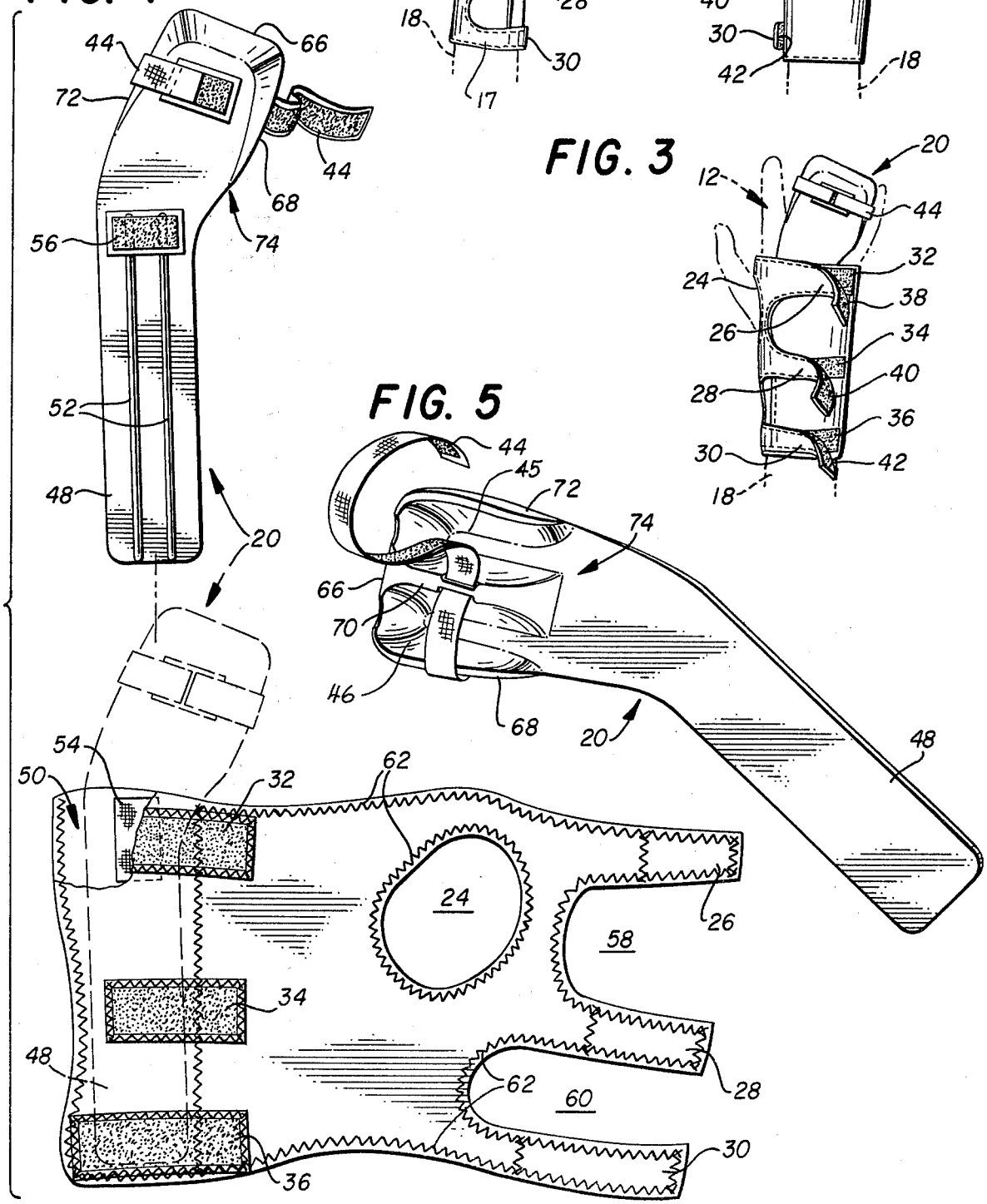
FIG. 5

BOWLING AID

BACKGROUND OF THE INVENTION

Many bowlers are unable to overcome common errors such as topping the ball, over turning the ball, short arming, and failing to follow through as the ball is released. Undue concentration on overcoming these deficiencies reduces the bowler's ability to concentrate on the proper area that the ball should be released to strike the pins. Accordingly, it would be desirable to be able to consistently control one's lift of the ball with the wrist, fingers, and arm by anchoring these parts of a person's anatomy in an optimum relative position, which in turn should cause the bowler to consistently release the ball in an appropriate manner each swing thereof, thereby improving the person's skill.

THE PRIOR ART

Pell U.S. Pat. No. 3,011,171 discloses a support which extends behind a finger. Lanning U.S. Pat. No. 4,176,840 discloses a brace which encapsulates the wrist, and a pad is rearwardly positioned respective to the brace, while another pad is located to support the back of the hand.

Massman U.S. Pat. No. 4,088,318 teaches a wrist support having a spring loaded forwardly positioned wrist engaging pad which is sprung from the wrist engaging part of the apparatus.

Ensinger U.S. Pat. No. 3,829,090 discloses a strap device which supports a bowler's wrist and hand on opposite sides of the wrist joint; and, Borden U.S. Pat. No. 3,606,319 provides a U-shaped panel member having finger loops at the end thereof for receiving the index and middle finger. A wrist band supports the apparatus in spaced relationship thereto. Reference is also made to the art cited in these five patents, as well as all of the classes and subclasses where all of these references may be classified.

None of the above prior art cited of record teaches a bowling aid which encapsulates the forearm, wrist, and the heel of the hand; while at the same time cooperating with the second and third fingers in a manner which anchors the wrist, fingers, and arm at a particularly set positioned to cause the bowler to release the ball in the same repetitive manner. A bowling aid apparatus which attains this desirable goal is the subject of the present invention.

SUMMARY OF THE INVENTION

A bowling aid is disclosed which can be attached to one's wrist and hand which enables a person to consistently deliver and control a bowling ball in an improved and unusual manner. The bowling aid comprises a panel member constructed of relatively flexible material which encloses one's hand, wrist, and arm. A rigid stiffener and finger guide member is mounted to the panel member, and includes a tongue-like member at one marginal end thereof and a finger guide member at the other marginal end thereof. The tongue is received in supported relationship respective to the panel, with the finger guide member extending forwardly therefrom.

A thumb cut-out formed into the panel receives the thumb therethrough, and overlapping edges of the panel member releasably secures the panel member to one's hand with a glove-like action. The tongue of the stiffener member is received within an outwardly opening pocket formed within the panel member so that the stiffener member is positioned closely adjacent to one's forearm, wrist, and back of the hand, with the finger guide member extending forwardly thereof into contact with the knuckle portion of the second and third fingers. Strap means maintains the two fingers within the finger guide.

The bowling aid provides a means by which the wrist, fingers, and arm are restrained in a manner to cause the bowler to release the ball in the same relative position each time. This helpful aid therefore enables the bowler to concentrate on the area where the ball should be released to strike the pins instead of concentrating on the relative position of his wrist, hand, and fingers while the ball is being released. The bowling aid therefore greatly improves one's skill over a period of time.

A primary object of the present invention is the provision of a means for restraining the forearm, wrist, hand, and fingers in an optimum manner while bowling with a bowling ball.

Another object of the present invention is the provision of a glove-like apparatus having a finger guide device attached thereto for maintaining the forearm, wrist, hand, and fingers aligned in a consistent, relative angle while bowling.

An additional object of the present invention is the provision of a device by which the extremity of an upper limb is maintained at a particular angle while bowling in order that a bowling ball is released in a consistent and desirable manner to thereby teach the bowler the most optimum position his limb should assume when the bowling ball is released.

These and various other objects and advantages of the invention will become readily apparent to those skilled in the art upon reading the following detailed description and claims and by referring to the accompanying drawings.

The above objects are attained in accordance with the present invention by the provision of apparatus fabricated in a manner substantially as described in the above abstract and summary.

BRIEF DESCRIPTION OF THE DRAWINGS

FIG. 1 is a side, perspective view of a bowling aid device made in accordance with the present invention, shown in operative relationship to a dot-dash representation of a person's forearm, wrist, hand, and fingers;

FIG. 2 is a bottom view of the apparatus disclosed in FIG. 1;

FIG. 3 is a top view of the apparatus disclosed in the foregoing figures;

FIG. 4 is an enlarged, disassembled view of the apparatus disclosed in the foregoing figures; and, FIG. 5 is a detailed view showing the bottom surface of part of the apparatus seen in FIG. 4.

DETAILED DESCRIPTION OF THE PREFERRED EMBODIMENT

FIGS. 1–3 illustrate a bowling aid 10, made in accordance with the present invention, and which is attached to a person's hand 12. The apparatus of the present invention includes a flexible panel member placed adjacent to one's wrist at 14. The outer marginal end of the panel member contacts the heel and back of the hand as indicated by the numeral 16. The inner marginal end 17 of the panel member encloses one's forearm 18.

A stiffener and finger guide member 20 is spaced from the panel member and receives the knuckles of a person's second and third fingers 22 in captured relationship therewithin. A cut-out forms a thumb hole 24 in the panel member.

As best seen illustrated in FIG. 4, together with other figures of the drawings, the panel member includes overlapping marginal edge portions which form a fastener means, and which preferably are in the form of a forward tab 26, middle tab 28, and rear tab 30. The opposed marginal outside surface of the panel is provided with Velcro fastener material 32, 34, and 36 for receiving Velcro fasteners 38, 40, and 42 which are applied to the inside of the before mentioned tabs 26–30. The fasteners are stitched to the panel as noted in the drawings.

As seen illustrated in FIG. 5, together with other figures of the drawings, a finger strap 44 is located at the outer marginal end of the finger guide and is roved about cavities 45 and 46. The cavities are placed adjacent to one another and outwardly open towards the knuckles of a person's hand. The cavities of the finger guide are located at the outer marginal end of the guide and stiffener member, while a tongue 48 forms the inner marginal end of the member.

As seen illustrated in FIG. 4, a pocket 50 is formed along one marginal edge portion of the panel member. The pocket outwardly opens towards the fingers of the hand for receiving the tongue 48 in supported relationship therewithin. The tongue includes spaced parallel ribs 52 which add rigidity to the stiffener or tongue portion of the member. The coacting part of the Velcro fastener material 54 is placed within the pocket in aligned relationship with respect to the Velcro fastener material 56 which is applied to a medial portion of the tongue in proximity of the termination of the ribs.

Cut-outs 58 and 60 are formed within the panel to provide the before mentioned tabs 26–30. Stitching 62 is the preferred method of fabrication of the pocket member.

The before mentioned pair of finger receiving cavities 45 and 46 are formed by a forward wall or nose piece 66, opposed outer sidewalls 68 and 72, and a bridge 70. The strap 44 preferably is received through an aperture or slot formed through the bridge. Velcro fastener material is applied to the marginal opposed ends of the strap so that the strap can be overlapped upon itself to thereby maintain one's second and third fingers properly restrained within the finger guide member in the illustrated manner of FIGS. 1–3.

The stiffener and finger guide member preferably is made of PVC or similar plastic material by ejection molding, although the member could be made of other plastics as well as being made of aluminum. The tongue can be heated and bent in order to custom fit the bowling aid to a person's forearm, wrist, and fingers.

The Velcro fastener material is glued or cemented onto the stiffener and finger guide member; and is attached by stitching to the panel member. The panel member is made of soft leather or plastic.

In operation, a person places his thumb through the thumb hole 24 and overlaps the tabs 26–30 so that the Velcro fasteners 32–36 are attached to the coacting Velcro fastener material 38–42 in the illustrated manner of FIG. 3, for example. The stiffener and finger guide member is maintained properly positioned within the pocket 50 by means of the Velcro fastener material 54 and 56. The knuckles of the second and third fingers are positioned within the cavities 45 and 46, with strap 44 being overlapped upon itself to thereby capture and maintain the fingers of the hand properly positioned respective to the panel member and the finger guide member. The tongue 48 reinforces the outer extremity of one's forearm, wrist, and the back of one's hand. The panel member restrains one's forearm, wrist, the heel and the back of the hand, so that the wrist, fingers, and arm are restrained in a set position and at an angle to provide the optimum release position of the hand respective to the ball at all times.

It is preferred to adjust the bowling aid so that wall 66 reaches about $\frac{1}{4}$–$\frac{3}{8}$ inches from the first knuckle of the fingers, with the middle knuckle of the fingers fitting into the cavity 45. When the bowling aid is properly fitted to a person's hand, the bowler can hold the ball at his side with no discomfort.

When the bowling aid has been fitted to one's hand, the aid will "bite" when the bowler forces the ball, fails to follow through, or tops the ball. These faults are eliminated by the present bowling aid.

I claim:

1. A bowling aid for restraining the movement of one's wrist, fingers, and forearm comprising:

a relatively, flexible panel member, a relatively stiff finger guide member;

said panel member includes a thumb receiving cut-out, side edges adapted to be fastened to one another, a forward marginal edge for engaging the heel and the back of the hand, and a rear edge for engaging the forearm;

said finger guide member includes a tongue, means by which said tongue is received in supported relationship by said panel so that stiffness is imparted into said panel;

said finger guide member includes a forward and opposed sidewalls, with there being a bridge therebetween, thereby providing two outwardly opening cavities within which the knuckles of the second and third fingers can be received;

said cavities of said finger guide member extends forwardly in advance of said tongue and panel, and receives the knuckles of the second and third fingers therewithin so that the fingers, hand, wrist, and arm are restrained in the optimum position for releasing a bowling ball.

2. The bowling aid of claim 1 wherein said tongue is placed at an obtuse angle respective to the cavities of said finger guide member;

said tongue is made of bendable material so that the angle between the hand and forearm can be changed by bending the tongue.

3. The bowling aid of claim 1 wherein said finger guide member is secured to said panel by inserting said tongue within an outwardly opening pocket, wherein said pocket is formed at a location which extends the finger guide member forwardly into a position located adjacent to the knuckles of one's hand;

said finger guide member is in the form of a relatively flat member with the finger engaging end thereof having means by which one's fingers are releasably secured within said cavities.

4. A bowling aid for encapsulating the wrist and hand of a bowler while restraining the second and third fingers of the hand, so that movement of the bowler's wrist, fingers, and forearm is restrained; comprising:

a relatively flexible panel member, a stiffener and finger guide member;

said panel member includes a forward edge portion for contacting the heel and the back of a person's hand, a rear edge portion for contacting the forearm and wrist, and opposed sides adapted to be brought about the hand and fastened together, and a thumb hole; fastener means by which the opposed sides are releasably fastened to one another;

one marginal end of said stiffener and finger guide member includes an elongated tongue member secured to the panel member for imparting stiffness thereinto; the opposed marginal end of the stiffener and guide member includes means for restraining the second and third fingers of the hand, and includes adjacent cavities within which the knuckles of the second and third fingers are releasably received;

said stiffener and guide member is secured to said panel member by an outwardly opening pocket formed at a location which extends the finger guide member forwardly into a position for receiving the fingers of one's hand; said cavities of said finger guide member extends forwardly in advance of said tongue and panel;

so that when the panel member is fastened about the hand, and the second and third fingers are positioned within the cavities, the relative position of the forearm, wrist, hand, and fingers are maintained at an optimum angle.

* * * * *